US011585179B2

(12) United States Patent
Woie et al.

(10) Patent No.: US 11,585,179 B2
(45) Date of Patent: Feb. 21, 2023

(54) SUBSEA EQUIPMENT INSTALLATION

(71) Applicant: CONOCOPHILLIPS COMPANY, Houston, TX (US)

(72) Inventors: Rune Woie, Tananger (NO); Leif Kvarme, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/493,301

(22) Filed: Oct. 4, 2021

(65) Prior Publication Data

US 2022/0106849 A1 Apr. 7, 2022

Related U.S. Application Data

(60) Provisional application No. 63/087,364, filed on Oct. 5, 2020.

(51) Int. Cl.
*E21B 33/035* (2006.01)

(52) U.S. Cl.
CPC ..... *E21B 33/035* (2013.01)

(58) Field of Classification Search
CPC ..... E21B 33/035
USPC ..... 166/368
See application file for complete search history.

(56) References Cited

U.S. PATENT DOCUMENTS 5,255,744 A * 10/1993 Silva ..... E21B 43/017 166/347
7,063,157 B2 * 6/2006 Bartlett ..... E21B 34/04 166/345
8,657,012 B2 * 2/2014 Fenton ..... E21B 17/01 166/85.1
2003/0221602 A1 * 12/2003 Guinn ..... E21B 19/002 114/258
2007/0163782 A1 * 7/2007 Keener ..... E21B 19/002 166/358
2010/0071906 A1 3/2010 Rodrigues
2013/0039701 A1 2/2013 Mille et al.
(Continued)

FOREIGN PATENT DOCUMENTS

GB 2466991 A * 7/2010 ..... E21B 19/002

OTHER PUBLICATIONS

International Search Report for PCT/US2021/053393 dated Jan. 18, 2022; 3 pgs.

*Primary Examiner* — Matthew R Buck
*Assistant Examiner* — Patrick F Lambe
(74) *Attorney, Agent, or Firm* — ConocoPhillips Company

(57) ABSTRACT

The invention relates to the drilling of subsurface oil and gas wells and the installation of subsurface equipment (11). A lifting vessel 7 brings heavy equipment such as Xmas trees or manifolds and wet parks this equipment (11) on the seafloor (5) during good weather when the significant wave height is low. The equipment (11), once it is underwater, has much lower weight and may easily be moved into place onto a wellhead (10) at an appropriate time using lower capacity lifting gear. The timing of this operation is much less sensitive to weather conditions because the equipment does not need to pass through the splash zone (sea surface). This makes for efficient use of expensive drilling rig time, and allows for acceleration of production of first wells on the template as critical heavy lifts could not else be done until rig has left the location. (FIG. 1).

11 Claims, 4 Drawing Sheets

(56) References Cited

U.S. PATENT DOCUMENTS

2016/0169414 A1* 6/2016 Ayestaran Basagoitia .....
F16L 1/123
405/173

* cited by examiner

SUBSEA EQUIPMENT INSTALLATION

CROSS-REFERENCE TO RELATED APPLICATIONS

This application is a non-provisional application which claims benefit under 35 USC § 119(e) to U.S. Provisional Application Ser. No. 63/087,364 filed Oct. 5, 2020, entitled "SUBSEA EQUIPMENT INSTALLATION," which is incorporated herein in its entirety.

STATEMENT REGARDING FEDERALLY SPONSORED RESEARCH

None.

FIELD OF THE INVENTION

This invention relates to the lifting of subsea equipment.

BACKGROUND OF THE INVENTION

In the field of offshore oil and gas, one of the tasks in setting up a subsea well for production of hydrocarbons is the installation of a subsea template, Xmas tree and manifold. Normally Xmas trees are set through a drilling rig or jack up rig, using the high capacity rig tower. The mass of a template can be as much as, e.g., 300 metric tonnes (300,000 kg). The mass of the manifold can be as much as 100 metric tonnes (100,000 kg) and the Xmas tree between 40 and 70 metric tonnes (40,000 to 70,000 kg). More recently, it has become possible to install these pieces of equipment using a specialized lifting vessel, or install a Xmas tree by a rig crane if there is available reach, rather than by the use of the costly drilling rig derrick/tower.

Waiting until a specialized lifting vessel is available, and then moving the rig away and bringing in the vessel all takes time and can add considerable expense. Often it is also necessary to wait for weather conditions which will allow the operation of moving away the rig and installing the template and/or manifold and/or Xmas tree with a lifting vessel—often the operation is only possible in the Summer. The constraint for both moving the rig and for lifting operations is normally a significant wave height of 1-2 m or possibly, in exceptional circumstances, 3 m; these are operations that involve working in the splash zone and are therefore very dependent on good weather conditions.

For the above reasons, the well or wells may be ready for Xmas tree and manifold to be installed and then several months' time may pass before it is possible to install these pieces of equipment, during which time the well is of course unproductive and other equipment may have to lie idle.

This invention described relates primarily to operations involving a jack-up rig. Jack-up rigs normally operate in relatively shallow depth of up to 100 m, though some unusual jack-ups can operate in deeper waters up to 150 m or even 200 m. Subsea wells are traditionally only used in relatively deep water, such as 300 m or deeper. However, subsea wells are becoming less expensive, and it is starting to become economic to use subsea wells instead of a platform at shallower depths, e.g., less than 200 m, or less than 150 m or less than 100 m. For example, subsea wells may now be placed at depth ranges from 20 m to 200 m or 30 to 150 m (and jack up rigs employed at these depths).

BRIEF SUMMARY OF THE DISCLOSURE

The inventors' idea is to choose an area of the seafloor close to the drilling site to be suitable for so called wet parking the template, Xmas tree and/or manifold on the seafloor, if necessary preparing the area in advance, e.g., by installing a mud mat. This will allow the template, manifold and/or Xmas tree to be deposited using a lift vessel (or the rig) at a time when the weather allows without it having to lower it though the air/water splash zone in severe weather, or regardless of whether the well is at a stage in its development when this equipment is required.

With the template, manifold and/or Xmas tree positioned on the seafloor, other well operations which are less weather sensitive can continue until the well is ready to have the template, Xmas tree and/or manifold installed. The template, manifold or Xmas tree can be finally deployed by maneuvering it underwater in an operation that is much less weather dependent. The operation can be carried out using a rig crane, surface lifting vessel, subsea winch or a combination of these, since the weight of the equipment underwater is less than in air so the capacity of the lifting equipment may be lower. For example, the rig with derrick draw work, the rig crane, or the rig crane possibly with support of a vessel, or a lifting vessel may lift or drag the equipment across the seafloor, or move the equipment while suspended just above the seafloor. With this method, the equipment may be maneuvered into position(s), without having to make the lift through the splash zone in a constrained weather period. If a rig crane is used, the crane capacity may be acceptable for nearby reach, but as crane capacity is reduced as the boom is lowered from upright towards horizontal to gain extended position to set down hoisted equipment, the crane capacity may be insufficient without aid or buoyancy elements.

This procedure has a number of advantages. Firstly, since the equipment does not have to be lifted through the splash zone, the operation is not so dependent upon the weather conditions and it is more likely at any given time that it will be possible to do the job. Secondly, since the equipment remains underwater throughout the operation, the maximum load which the rig crane or vessel crane is required to bear is less than it would be if the equipment had to be lifted through the air. Thirdly, since the equipment remains underwater during the operation, it is possible to attach buoyancy, e.g. air tanks, to it in order to reduce the maximum load still further. Buoyancy may be attached to the equipment or pre-attached buoyancy devices, such as bags or tanks, may be inflated when the time comes for moving the equipment. Fourthly, wells in a larger template having a large number of slots (e.g. 4 to 8 slots) can more easily be put on production one by one rather waiting for a complete finished predrill. In this way, production can be accelerated.

It may be that the parked equipment is not directly below a position accessible to the lifting equipment (such as a rig derrick) which is to be used, but in this case a further (e.g. temporary) lifting point on the equipment can be employed and the equipment moved into its final position using a combination of two lifting or hauling devices (such as a rig derrick and a seafloor winch). The skilled reader will appreciate that there are many options, once the equipment is located on the seafloor with reduced effective weight.

For example, the technique may involve placing anchoring/piling winch(es) on the seafloor or on a mud mat that enables lifting of the equipment from the seabed using a sheave mounted underneath the rig or vessel, or using the winch to control descent or the lateral movement of the subsea equipment, Xmas tree or manifold from the wet parked area to other position.

The inventors have also found that it is possible to perform drilling operations in parallel with installation of a subsea VXT on a subsea template, using the same drilling rig. Drilling operations are conducted through one slot of a subsea template using the rig tower, whilst a rig crane is used to install a VXT on an already drilled well in a different slot of the same template. The parallel use of the drilling rig saves considerable rig time. This operation is facilitated if the VXT has previously been installed on the seabed and potentially fitted with buoyancy, etc., so that there is a smaller load for the rig crane to support.

The invention more particularly includes the features set out in the first of the claims appended to this specification. Optional features are described in the remaining claims.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the or scope of the underlying inventive concept will become apparent to those skilled in the art from this disclosure.

As used herein, the term "buoyant" means having a density lower than that of seawater.

As used herein the term "significant wave height" is defined as the average wave height, from trough to crest, of the highest one-third of the waves.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
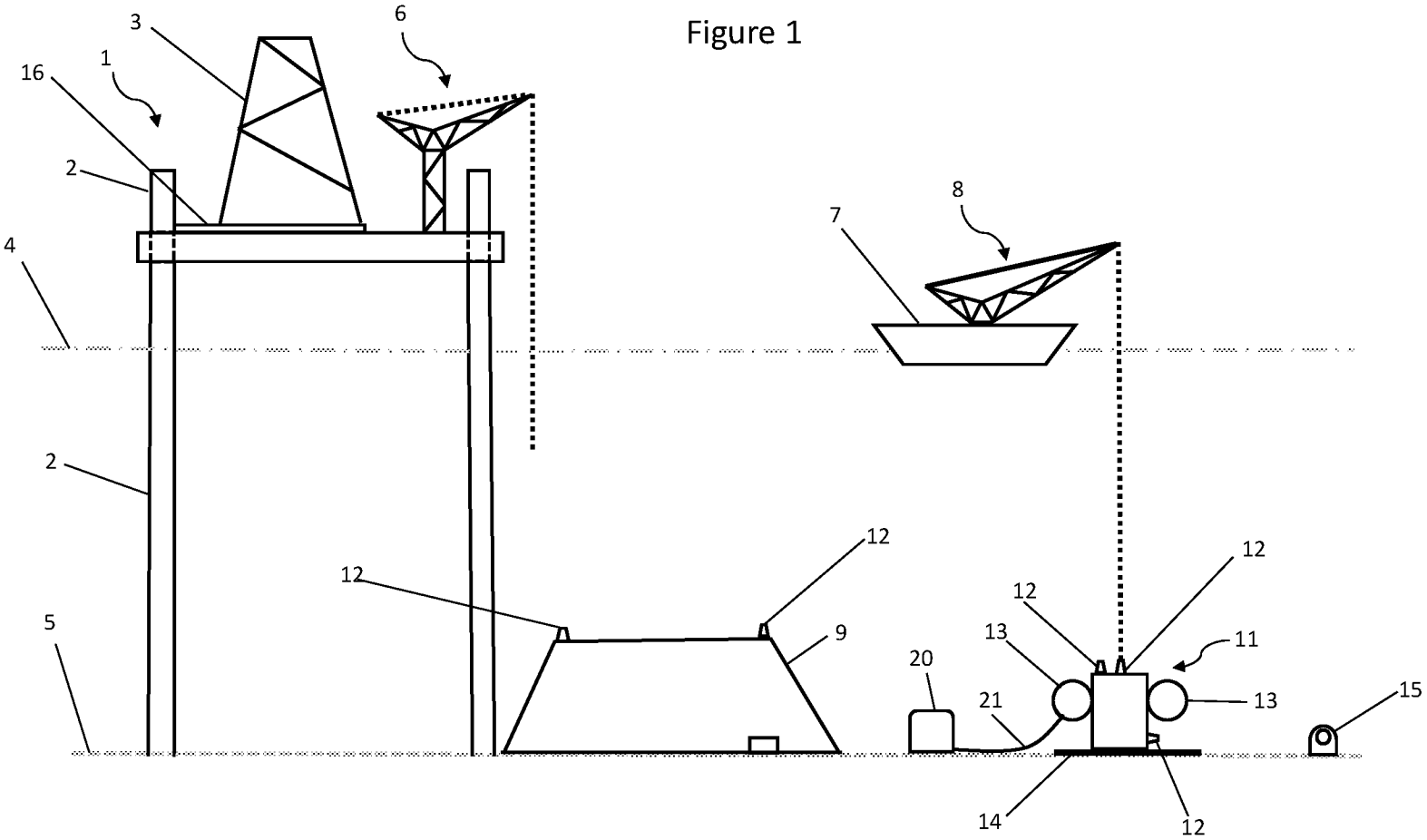
FIG. 1 is a schematic showing subsea equipment and lifting facilities which may be used in accordance with the invention, including a surface vessel having deposited subsea equipment on the seafloor.

As shown in FIG. 1 in highly schematic form, a jack-up rig 1 rests on the seafloor 5 with its legs 2 passing through the surface 4 of the sea. A high lifting capacity rig tower 3 is located on the jack-up 1. The rig derrick 3 (also called rig tower 3) is mounted on a cantilever structure 16 which, in FIG. 1, is not deployed but can be used to position the rig tower 3 such that it has a reach beyond the deck of the rig (see FIGS. 2 and 3). The jack-up 1 also has a rig crane 6 with a lower lifting capability than the tower 3.

A specialized high capacity lifting vessel 7 is shown, on which is mounted a high capacity crane 8. On the seafloor is a drilling template 9 which has previously been placed into position at a planned drilling location, either using methods in accordance with the invention or not. A well has been drilled through the template 9 and a wellhead 10 has already been installed. The template 9 has lifting/hauling points 12.

Also located on the seafloor in proximity to the template 9 is a heavy piece of equipment 11 which needs to be mounted on the wellhead 10. The equipment 11 could be a manifold or a Xmas tree or both. The equipment includes one or more lifting/hauling points 12 which may be permanent or temporary. Buoyancy tanks 13 are attached on each side, or above, of the equipment 11; these were installed before or after lowering the equipment to the seafloor, possibly only inflated/made buoyant after being placed in the sea, to reduce the size and weight of the equipment for further maneuvering operations. The buoyancy elements may be inflated using high pressure air/gas, at sufficient pressure to fill the buoyancy elements as the water depth hydrostatic pressure is significantly less. The gas is supplied from a pressurized tank 20 on the seafloor via a high pressure line 21. Alternatively, the pressurized gas may be supplied from the surface. The equipment 11 rests on a mud mat 14 on the seafloor 5. A seafloor-mounted winch 15 is located nearby.

In a first embodiment of the invention, the subsea template, having a mass of 100 metric tonnes (100,000 kg) is transported by the vessel 7 to an intended drilling location, in the Summer during a period of good weather. The conditions include a significant wave height of 1 meter, which is calm enough to allow the vessel 7 to lower the template 9 through the surface 4 of the sea (the splash zone) using its crane 8 and attachment points 12 on the template. The template may either be lowered directly onto a site prepared for drilling, or it may be parked on the seafloor nearby until it is needed, and then maneuvered into position using any combination of the surface vessel crane 8, rig crane 6 and seafloor winch 15. The rig tower 3 may also be used. Once the template has been placed on the seafloor, its effective weight is much less which means that it is not normally necessary to employ the rig tower 3 or such a high capacity surface vessel crane as was used to locate it initially. Thus, the relatively low capacity rig crane 6 may be used together with one or more seafloor winches 15 or a lower capacity lifting vessel. Furthermore, the process of moving the template into position is much less weather dependent than the initial lowering operation and so there is more flexibility about when this process is carried out. Once in position, the template 9 is securely anchored to the seafloor 5.

A Xmas tree or manifold (equipment 11) will not be required until a well has been drilled through the template 9 and wellhead 10 installed using the drilling rig 1. However, while the weather conditions are good, the equipment 11 can be wet parked. The equipment may comprise a heavy manifold or Xmas tree with masses of 100 and 70 metric tonnes respectively. The high capacity surface vessel crane 8 may wet park the equipment 11 on the seafloor 5 during good weather conditions when the significant wave height is 1 m. The equipment 11 may then be left until the rig 1 has finished drilling operations.

When drilling has been completed, the equipment 11 may then be installed on a wellhead 10. With the equipment underwater its effective weight is reduced and so it may be handled by lower capacity lifting/hauling equipment. Weight may be further reduced by adding buoyancy tanks 13. Also, the timing of this operation is not as sensitive to weather as the operation of lowering the equipment though the splash zone.

Commonly, a template may have 4 or more slots for drilling. Each well requires a Xmas tree and manifold. By parking all the necessary Xmas trees and manifolds in advance during good weather, it becomes possible to bring one or more of the wells online pending drilling and completion of the others.

Figure 2:
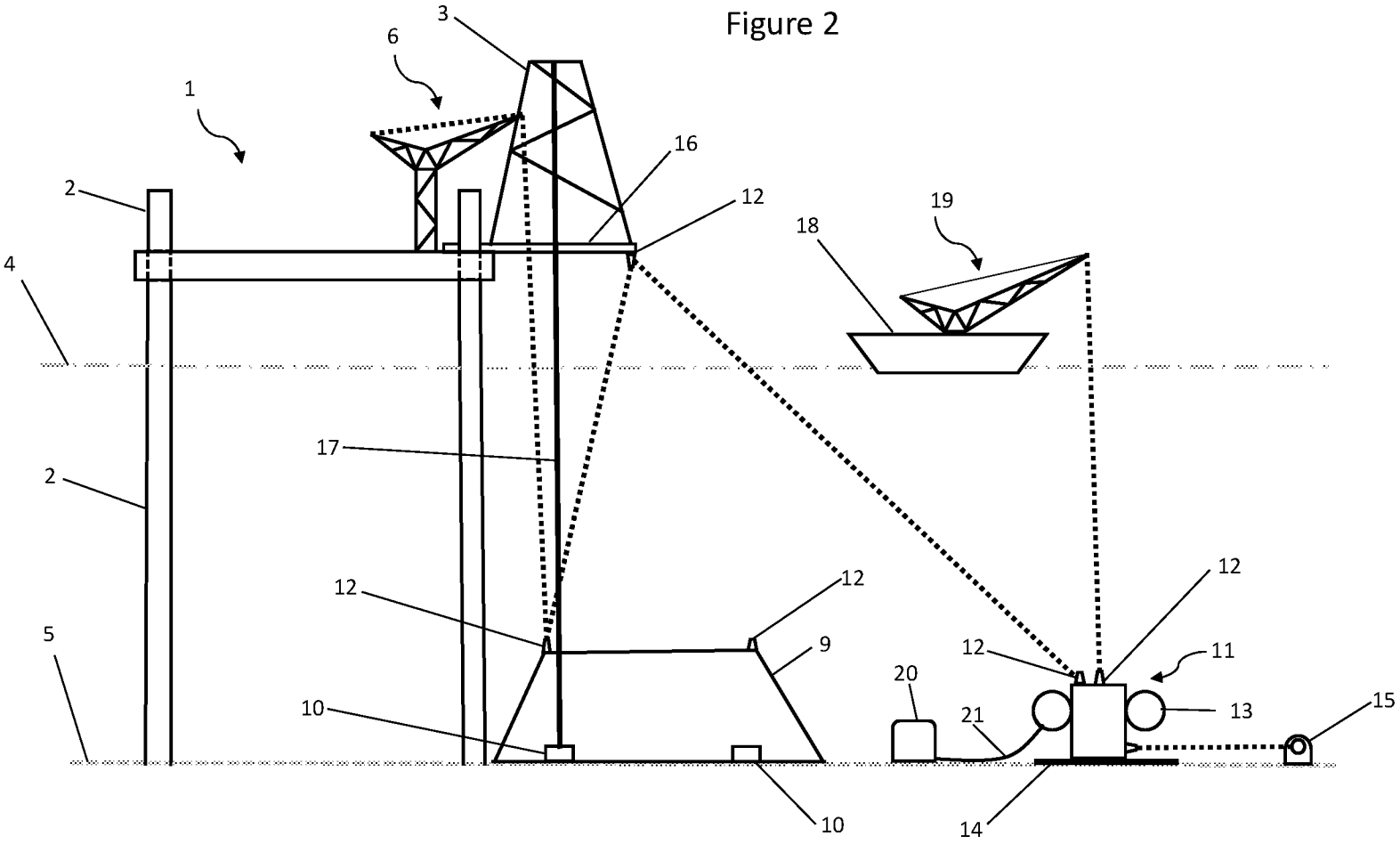
FIG. 2 is an illustration similar to FIG. 1 showing one possible combination of lifting equipment for maneuvering the equipment into place on a wellhead and also showing drilling being performed in parallel with lifting.

FIG. 2 shows the drilling rig tower 3 deployed on cantilever structure 16. A drill string 17 is shown performing operations in a well, with wellhead 10. The other of the two illustrated wellheads 10 is ready to receive a Xmas tree/manifold.

FIG. 2 shows various lifting equipment attached to the parked Xmas tree/manifold 11 ready to move it into position. This is only one example and there are many other possibilities. A relatively low capacity lifting vessel 18 (in comparison to the vessel 7 of FIG. 1) is shown with its crane 19 attached to the equipment 11. The rig crane 6 has its cable running through a lifting point/pulley 12 on the template and a similar point on the deployed cantilever structure 16, and then attached to the equipment 11. The seafloor winch 15 has a cable attached to a hauling point 12 on the subsea equipment 11.

Using all three pieces of lifting/hauling equipment, the Xmas tree/manifold may be lifted and moved laterally into position on the wellhead 10. During this operation, the rig tower 3 and drill string 17 can be employed on the other well.

Figure 3:
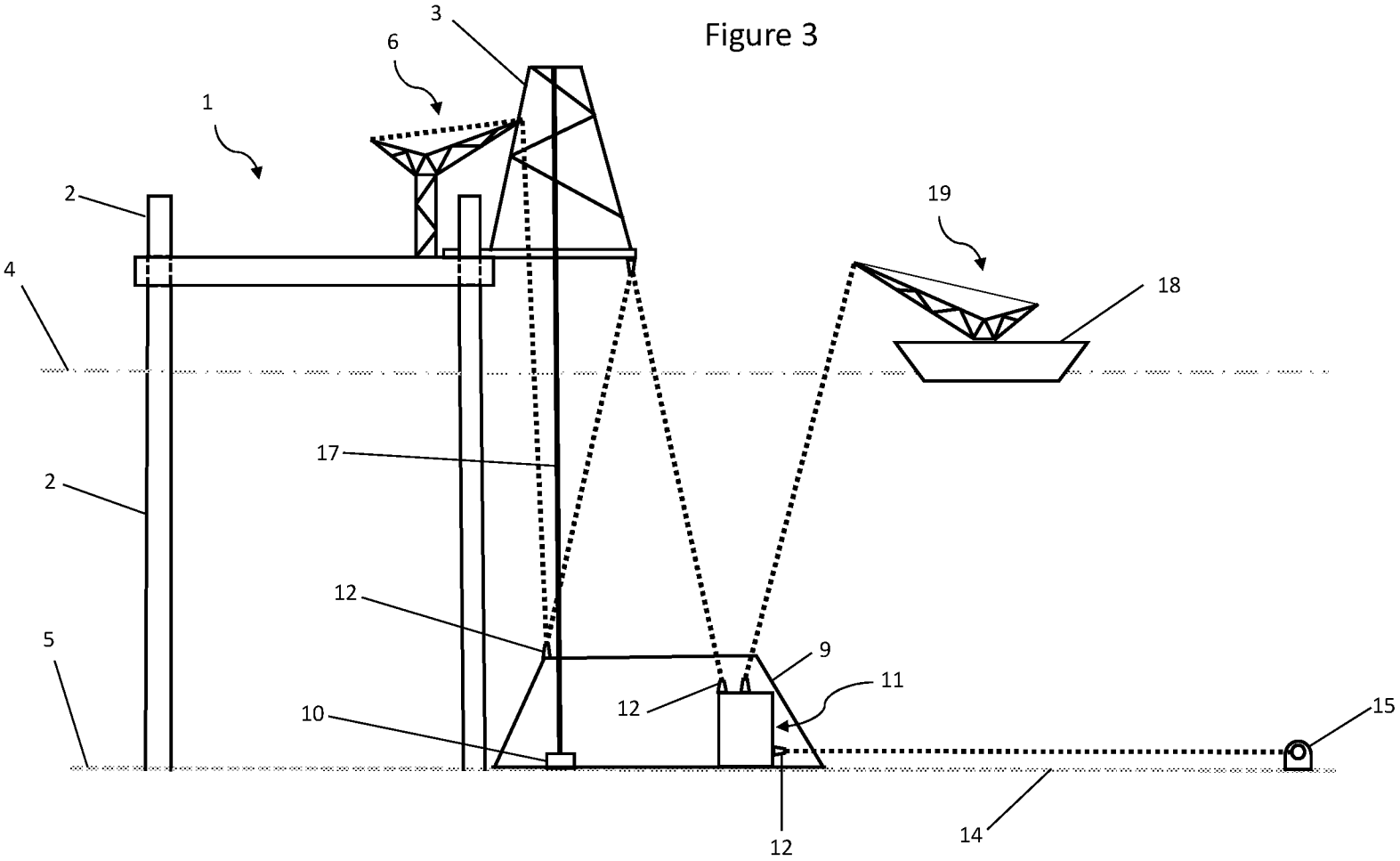
FIG. 3 is an illustration similar to FIG. 2 showing the equipment in place on the wellhead/template.

FIG. 3 shows the equipment 11 in position. The lifting equipment is still attached to show how the various cables have moved during the operation. The buoyancy tanks 13 have been removed at this stage. The rig tower 3 and drill string 17 continue to operate on the other wellhead 10.

Figure 4:
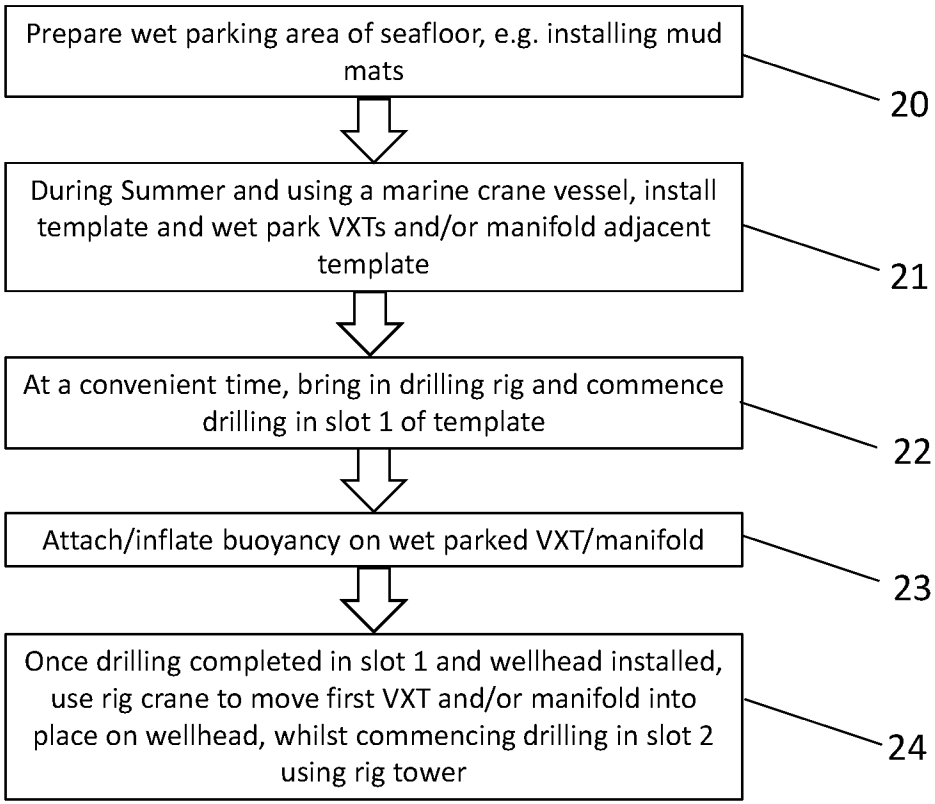
FIG. 4 is a flow chart showing an exemplary sequence of steps for the method according to the invention.

FIG. 4 shows an exemplary sequence of steps: first, prepare the seafloor (step 20); second, during the Summer and using a specialized lifting vessel, install the template and wet park VXTs (vertical Xmas trees) and manifold adjacent the template (step 21); third, at a convenient time move in the jack-up rig and drill the first well (step 22); fourth, attach any buoyancy required (step 23); fifth, commence drilling a second well in the template whilst using a rig crane on the rig to position, or help position, a VXT or a manifold on the wellhead of the first drilled well (step 24).

In this example, the manifold is installed before the VXTs, so whilst the second slot is being drilled the manifold is moved into place followed by the first VXT. Depending on the design of the equipment, the manifold may be installed after the VXTs, in which case only the first VXT is installed in parallel with the drilling of the second slot and the manifold would be installed at the end of the procedure.

Obviously, step 24 can be repeated until all slots in the template have been drilled and the manifold and all VXTs placed.

Depending on the weight of the equipment and the starting and finishing positions, it may be possible to perform the maneuvering operation with different combinations of equipment, e.g. no lifting vessel and/or more than one seafloor winch. The rig tower itself could be employed to lift, but normally this would not be done because this would take the rig tower away from other well drilling and preparation operations which only it can perform.

As can be seen from the above description of a specific example, the advance wet parking of the heavy equipment and the reduction of the load using buoyancy elements allows a rig crane or rig draw work to pick up the parked equipment from seafloor. In the described method, lift may be provided by a combination of a crane with another lifting point or device. In this way, sufficient lift may be provided for the lift and installation move from the parked position onto the planned position on the well template or wellhead. A buoyancy device suitable for this purpose may be, for example, a submerged tank to be filled with air before the lift and emptied after the lift. Alternatively, buoyancy elements may be attached t the modules when parked, and then carefully released after installation.

At a time when the weather is acceptable, the transport crane vessel can move to a position above the planned wet parking area on the seafloor. This area may be next to the rig operating on a template/well(s). A mud mat with the necessary strength may first be installed on the seafloor, and buoyancy elements/equipment also placed on the seafloor. The manifold and Xmas tree and other heavy equipment may then be placed on the mud mat(s). During installation or after landing on the mud mat, buoyancy elements/equipment of sufficient capacity to allow for the use of a surface crane are installed/added/inflated.

The transport vessel may then be moved away. When ready for installation the rig crane may lower its crane hook and lifting gear into the sea above the equipment to be installed. An ROV may attach the lifting gear to the equipment. The lifting gear may comprise either only a crane hook for direct installation, or as required an additional hook(s) may be provided for one or more additional lifting device(s) on surface to enable the equipment may be lifted only slightly and moved laterally to the final intended installation point on the template, well or other position under the rig.

During the lateral movement, the load transfer happens as the surface crane moves, or when hoisting the next lifting device to a point where the next secondary lifting device has taken the full load, and the crane load is zero and thereafter its hook released from the equipment. In its final installation position, the equipment is lowered down and installed and hooked up on to the well or template or set on the seafloor in the final position. In this final position the last hooks(s) are released. The buoyancy elements/equipment is thereafter controlled by deflating or removing/detaching it.

Avoiding the possible weather delays during rig move phase, and later equipment installation (impacting first oil) is a big advantage. Running the subsea equipment through the sea surface/splash zone when the average wave height is low reduces uncertainties for installation. Early installation with the rig also enables single wells in a template to be put on production earlier as the rig does not have to complete the operation and can be moved away before wells are completed. Another direct improvement on early installation is the ability of secondary well intervention to repair of intervene on the producing well whilst the rig is in place rather having to call in the rig later if unforeseen repair is required.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for installing subsea equipment comprising a subsea Xmas tree or manifold in an installation region of seafloor, the process comprising:

(a) wet parking the equipment on the seafloor in proximity to the installation region using a marine vessel with a crane, including lowering the equipment through the splash zone at a time when the significant wave height is less than 3 m;

(b) subsequently repositioning the equipment into the installation region, wherein the equipment remains underwater throughout the repositioning operation;

wherein, prior to step (b), a subsea template comprising a plurality of template slots is installed in the installation region and, also prior to step (b), a plurality of Xmas trees and/or manifolds are wet parked on a wet parking area of the seafloor adjacent the installation region, and wherein step (b) involves installing a plurality of Xmas trees and/or manifolds in respective template slots in the template, and further wherein a drilling rig crane is employed in step (b) to position the equipment in a first one of the said template slots whilst a drilling rig tower of the drilling rig performs a drilling operation in a second one of the said template slots.

2. The process according to claim 1, wherein preparing the wet parking area comprises installing a mud mat on the seafloor.

3. The process according to claim 1, wherein, prior to step (b), the buoyancy of the subsea equipment is increased.

4. The process according to claim 3, wherein the buoyancy of the subsea equipment is increased by (i) attaching buoyant members to the equipment, or (ii) inflating pre-attached inflatable buoyancy devices.

5. The process according claim 4, wherein compressed gas or air supplied by a hose from the surface or from temporary tanks is used to fill the inflatable buoyancy devices.

6. The process according to claim 1, wherein step (b) is performed using two or more cranes or other lifting or hauling devices at different locations simultaneously in order to move the subsea equipment laterally onto the installation region.

7. The process according to claim 1, wherein a time interval between steps (a) and (b) is up to 2 years.

8. The process according to claim 1, wherein there is a time interval of between 1 week and 2 years between the installation of a first and a second of the said manifolds and/or XMas trees.

9. The process according to claim 1, wherein the drilling rig is a jack-up rig and the water depth is from 20 to 200 m.

10. The process according to claim 9, wherein the water depth is from 30 to 150 m.

11. The process according to claim 9, wherein the water depth is from 30 to 100 m.

* * * * *